United States Patent [19]

Chandhoke

[11] 4,436,297

[45] Mar. 13, 1984

[54] HORIZONTAL BINDERY LOADER ADAPTOR FOR FEEDING SIGNATURES INTO A VERTICAL POCKET

[75] Inventor: Mohanjit S. Chandhoke, Plattsburgh, N.Y.

[73] Assignee: Harris Graphics Corporation, Melbourne, Fla.

[21] Appl. No.: 268,170

[22] Filed: May 29, 1981

[51] Int. Cl.[3] ..... B65H 1/30; B65H 1/02; B65H 3/12

[52] U.S. Cl. ..... 271/3.1; 271/94; 271/DIG. 9; 271/150; 271/162; 271/171; 414/104

[58] Field of Search ..... 271/3.1, DIG. 9, 3, 271/4, 5, 6, 7, 149, 150, 151, 162, 163, 164, 184, 185, 161, 165, 166, 197, 209, 213, 94, 96, 35, 171; 414/104, 33, 32

[56] References Cited

U.S. PATENT DOCUMENTS

| | | | |
|---|---|---|---|
| 1,147,482 | 7/1915 | Cheshire | 271/161 |
| 1,593,563 | 7/1926 | Blaine | 271/164 |
| 2,956,801 | 10/1960 | Coakley | 271/5 |
| 3,501,139 | 3/1970 | Stobb | 271/184 X |
| 3,542,360 | 11/1970 | Carey . | |
| 3,635,463 | 1/1972 | Stobb | 271/3.1 X |
| 3,650,525 | 3/1972 | Hageman et al. . | |
| 3,904,191 | 9/1975 | Maier, Jr. et al. | 271/150 |
| 3,945,633 | 3/1976 | Knopp | 271/3.1 |
| 4,081,181 | 3/1978 | Crowe et al. | 271/3.1 |
| 4,177,982 | 12/1979 | Bewersdorf et al. | 271/5 |
| 4,180,259 | 12/1979 | Bewersdorf et al. | 271/200 |
| 4,183,517 | 1/1980 | Hageman | 271/150 |
| 4,219,191 | 8/1980 | Rastorguyeff | 271/3.1 |

FOREIGN PATENT DOCUMENTS

| | | | |
|---|---|---|---|
| 17838 | 10/1980 | European Pat. Off. | 271/3.1 |

*Primary Examiner*—Bruce H. Stoner, Jr.
*Assistant Examiner*—Lisa Rosenberg
*Attorney, Agent, or Firm*—Yount & Tarolli

[57] ABSTRACT

A loader for feeding signatures into a generally vertically extending pocket in which the signatures are supported on a folded edge and from which signatures are fed by a feed mechanism, such as through a signature inserter, to a saddle of a saddle gathering machine, wherein a generally horizontally oriented hopper is located between a first feeding mechanism from a supply station and a second feeding mechanism to the pocket, a quickly detachable coupling arrangement is provided for forming the pocket with the loader, and the second feeding mechanism includes an adjustably mounted vacuum manifold and perforated stripper belts for moving signatures in a shingled stream into said pocket.

9 Claims, 19 Drawing Figures

HORIZONTAL BINDERY LOADER ADAPTOR FOR FEEDING SIGNATURES INTO A VERTICAL POCKET

BACKGROUND OF THE INVENTION

The present invention pertains to a loader or apparatus for feeding signatures into a generally vertically extending pocket in which the signatures are supported on a folded edge and from which the signatures are fed by a feed mechanism, such as through a signature inserter to a saddle of a saddle gathering machine, as used in the manufacture of books, magazines, etc.

The present invention relates to a so-called "vertical hopper loader" since the signatures are fed into a generally vertically extending pocket. Feeding signatures into a generally vertically extending pocket in this manner is generally more difficult than feeding signatures by a "horizontal hopper loader", into a generally horizontally extending pocket or hopper, examples of which "horizontal hopper loader" are shown in prior art U.S. Pat. No. 3,674,258 granted on July 4, 1972 to Robert E. Maier, Jr. and James R. Moser on "Method and Apparatus for Feeding Stacked Sheet Material" (hereinafter called "'258 patent") and U.S. Pat. No. 3,904,191 granted Sept. 9, 1975 to Robert E. Maier, Jr. and Joseph P. McGinnis on "Hopper Loading Method and Apparatus" (hereinafter called "'191 patent"), respectively, having at its loading station signatures horizontally oriented and generally vertically oriented.

Some of the vertical loaders in the prior art include (1) U.S. Pat. No. 4,183,517 granted Jan. 15, 1980 to Carlton V. Hageman and James C. Wise on "Apparatus and Method for Delivering Signatures to a Gatherer." Hageman et al. disclose a mechanism for individually releasing signatures comprising pins controlled by solenoids actuated by photodetector relays and (2) parent and divisional U.S. Pat. No. 4,177,982 granted Dec. 11, 1979 and U.S. Pat. No. 4,180,259 granted Dec. 25, 1979 to Elmer Bewersdorf et al. on respectively "Sheet Feeders" and "Varying the Drop of Sheets into a Hopper", hereinafter collectively called the "Bewersdorf et al. patents".

Bewersdorf et al. disclose a feeder which comprises a supply station in which signatures are stacked on their folded edge, and feeding means for delivering signatures into a vertical hopper. An upright stop plate is provided for supporting the signatures at the supply station. The feeding means includes a pair of feed belts for delivering signatures to the vertical hopper, and a suction manifold and stripper belts for individually extractting signatures from a stack of signatures leaning against the stop plate.

Difficulties in operating vertical loaders such as disclosed in Bewersdorf et al. patents consist in that a large quantity of signatures cannot be loaded in the loader without interfering with the predetermined feeding of signature at the supply station, and that the loaders cannot handle very short and very long signatures without substantial changes in the feeding mechanism. Further, the loaders are characterized by a constant riffling, sliding and jostling action that results in damage to the folds on the signatures when they move between conveyor belts.

SUMMARY OF THE INVENTION

The present invention provides a vertical loader which avoids or obviates problems encountered in the prior art loaders such as disclosed in Bewersdorf et al. patents.

According to the present invention there is provided a vertical loader comprising a generally horizontally oriented hopper that receives and stores signatures in a vertically aligned pack, first feeding means for feeding signatures from a supply station into the hopper, and second feeding means for feeding signatures from the hopper into a substantially vertical pocket formed between the loader and an inserter for feeding signatures onto a saddle of a signature gathering apparatus. The second feeding means includes an adjustably mounted vacuum manifold and a perforated stripper belt for moving the signatures off the bottom of the hopper in a shingled stream into the pocket. The perforated stripper belt forms the bottom of the horizontal hopper. Sensing means is provided for sensing the thickness of the pack in the horizontal hopper and the pocket respectively to control the operation of the first and second feeding means respectively.

According to another feature of the invention, there is provided quickly detachable coupling means for coupling the loader and the inserter to form a substantially vertical pocket from which signatures are fed into associated bindery equipment.

BRIEF DESCRIPTION OF THE DRAWINGS

The invention is illustrated in the accompanying drawings showing a preferred embodiment, including specific parts and arrangement of parts. It is intended that the drawings, included as a part of this specification, be illustrative of a preferred embodiment of the invention only and should in no way be considered as a limitation upon the invention itself.

DETAILED DESCRIPTION OF PREFERRED EMBODIMENT

A book, made up of many folded pages or signatures S, is manufactured by gathering or assembling its signatures S in proper sequence on saddle 18*a* on gathering machine or conveyor 18 in FIGS. 1 and 1*a* moving in the direction of the arrow in FIG. 1, and by subsequently binding signatures S in book form by a saddle binder.

Figure 1:
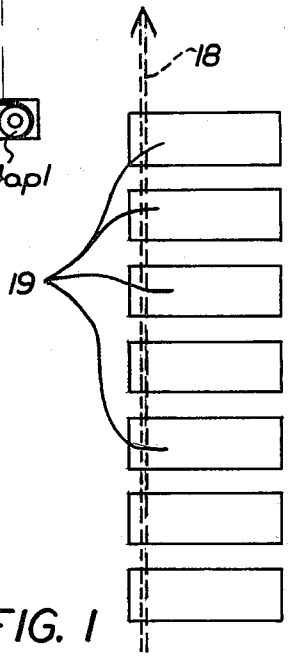
FIG. 1 is a schematic view of a saddle gathering machine having a pluraltiy of signature feeding units spaced along its length.

Along the length of saddle gathering machine 18 in FIG. 1 are a plurality of similar signature feeding units 19, each including a signature inserter 21 and a signature loader 20, so each unit 19 feeds a different signature to saddle gathering machine 18, with one signature dropped atop another on its traveling saddle 18*a* until the complete book is formed.

Figure 1A:
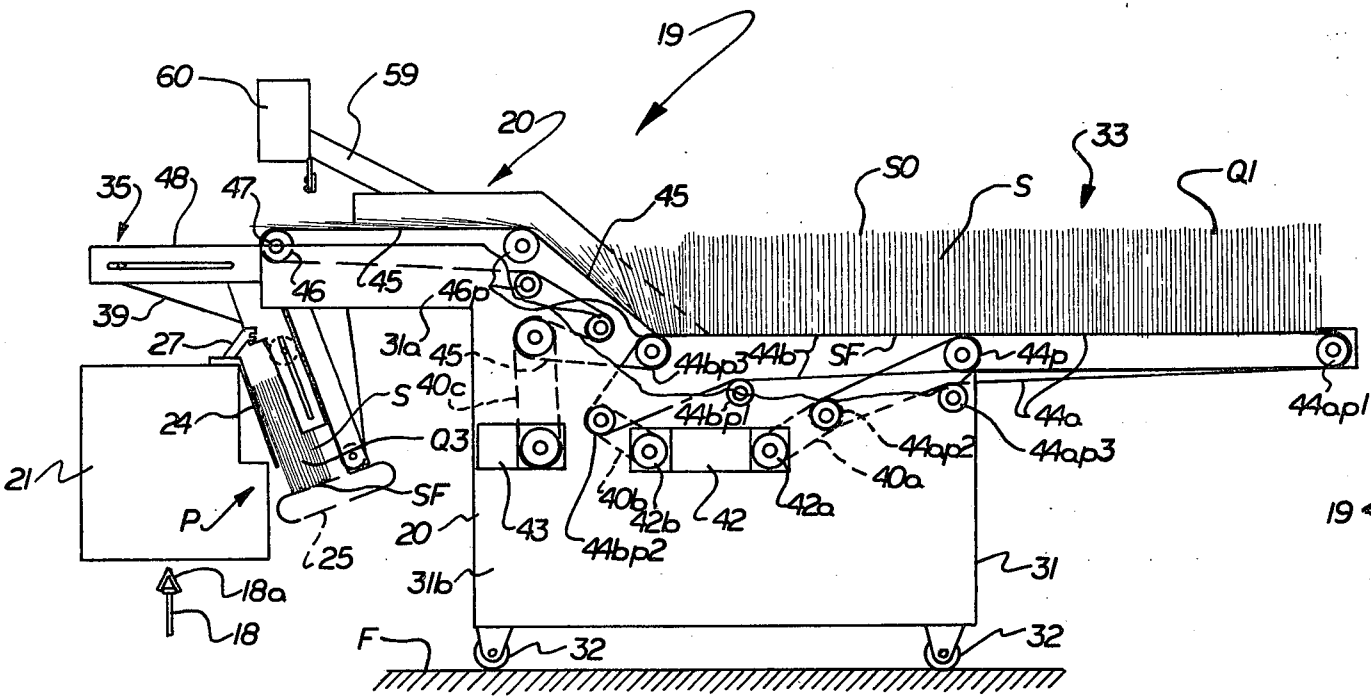
FIG. 1*a* is a side elevational view of a signature feeding unit in FIG. 1, comprising a loader (for feeding signatures into a generally vertically extending pocket, in which the signatures are supported on their folded edges) coupled to a signature inserter (located over a saddle gathering machine) through which the signatures are fed from said pocket.

Signature feeding apparatus or loader 20 is coupled to, and used with, any suitable form of signature inserter 21 in FIG. 1*a* for feeding signatures S into a vertically extending pocket P—formed where loader 20 and inserter 21 are coupled together in FIG. 1*a*, in which the signatures S are supported on their folded edges SF, and from which signatures S are fed by and through signature inserter 21 to saddle 18*a* of saddle gathering machine 18.

Signature inserter 21 and saddle gathering machine 18 may take any suitable form and may be of the type disclosed in U.S. Pat. No. 4,180,255 granted Dec. 25, 1979 to Ronald G. Himmel on a "Wiper System Inserter", hereinafter called "'255 patent". Pocket P in FIG. 1*a* of the present drawings is loaded with signatures S—in a generally vertical position, supported by end or face plate 24, maintained against face plate 24 by intermittently operated conveyor means or feed rack inserter 25, having their signature folded edges SF downwardly against the surface of conveyor means 25, and arranged so that a vacuum sucker in signature inserter 21 can be moved once per feeding cycle into the opening between face plate 24 and conveyor means 25 to pull the lefthand, endmost signature S into inserter 21, wherein signature S is subsequently opened, transferred, spread and dropped onto saddle 18*a* of saddle gathering machine 18 in a manner shown in more detail in that '255 patent.

FIGS. 1 and 1*a* show a desirable arrangement of the component parts because it is desirable that the left side of the saddle conveyor or saddle gathering machine 22 in FIG. 1*a* be clear for access by the machine operator for setting up the machine initially, and for correcting malfunctions as the machines operate. Hence, unit 19 and loader 20 extend off to the right in FIG. 1*a*, is loaded from its righthand side in FIG. 1*a*, and includes wheeled frame 31 supported on wheels or casters 32 to permit loader 20 to be rolled from the right toward inserter 21 and to permit coupling together loader 20 and inserter 21 by coupling means 27 described hereinafter.

Loader 20 is basically a feeding means on frame 31 for sequentially feeding signatures S individually from pack Q1 of signatures in supply or loading position or station 33 in a shingled stream overlap with signature folded edge SF leading, or directed into, generally vertically extending pocket P, to form signature pack Q3 at this delivery position or station.

Loader 20, broken down into its major components, includes: (1) hopper 35 on frame 31, generally horizontally oriented and arranged to receive signatures S in a generally horizontal array; (2) first feeding means 37 on frame 31 for feeding signatures S from pack Q1 of signatures S at loading position 33 in a shingled stream into hopper 35, with signature folded edge SF trailing and signature open edges SO leading; and (3) second feeding means 39 on frame 31 for feeding a shingled stream of signatures S from pack Q2 in loading or loaded position in hopper 35, with folded signature edges SF leading out of hopper 35, sequentially from the bottom of hopper 35 and for directing signatures S on folded edges SF into pack Q3 in generally vertically extending pocket P. Note that feeding means 37, 39 feed signatures S in opposite directions into and out of hopper 35. If desired, signatures S may be fed only through second feeding means 39 by loading signatures S directly into hopper 35 in its loading position to provide pack Q2 of signatures at the loading position for directing signatures S into generally vertically extending pocket P.

First feeding means 37 includes horizontal bindery hopper loader 41 with suitable signature conveyor means. Motor 42 on frame 31 drives respectively through its opposite drive ends 42*a*, 42*b* in FIG. 1*a*, drive belts 40*a* and 40*b*; and horizontal belts 44*a* and 44*b* on drive pulleys 44*p*, 44*ap*1, 44*ap*2 and 44*ap*3, and 44*p*, 44*bp*1, 44*bp*2 and 44*bp*3 rotatably mounted on frame 31. Motor 43 on frame 31 drives drive belt 40*c*, and belts 45 having inclined and horizontal positions trained over pulleys 46 and 46*p* rotatably mounted on frame 31.

First feeding means 37 may take any suitable form such as horizontal bindery hopper loader 41 in FIG. 1*a* of the type disclosed in aforementioned '191 patent. In FIG. 1*a* in the present drawings, signatures S are placed in a horizontal stack, having generally vertically extending signatures S, at loading station or position 33 on horizontal portions of conveyor belts 44*a* and 44*b* with signature open edges SO facing upwardly in FIG. 1*a* and with signature backbones or folded edges SF located on the lower edge of the pack against conveyor belts 44*a*. Motor 42 (driving suitable conveyor means 44*a* and 44*b*) moves this pack or stack of signatures S at loading position 33 toward the left in FIG. 1*a* by horizontal portions of conveyor belts 44*a* and 44*b* of the conveyor means. Motor 43 has an intermittent drive so that it intermittently drives inclined portion of conveyor belts 45 of the conveyor means to feed signatures S upwardly to the left on inclined portions of belts 45 of the conveyor means, and to the left on the upper horizontal portion of conveyor belts 45 of the conveyor means, which belts 45 are trained over rollers 46 in FIG. 4 spaced lengthwise along, and rotatably mounted on, shaft 47 secured against rotation at opposite ends to frame side plate 31*a;* and into horizontal hopper 35.

Figure 3:
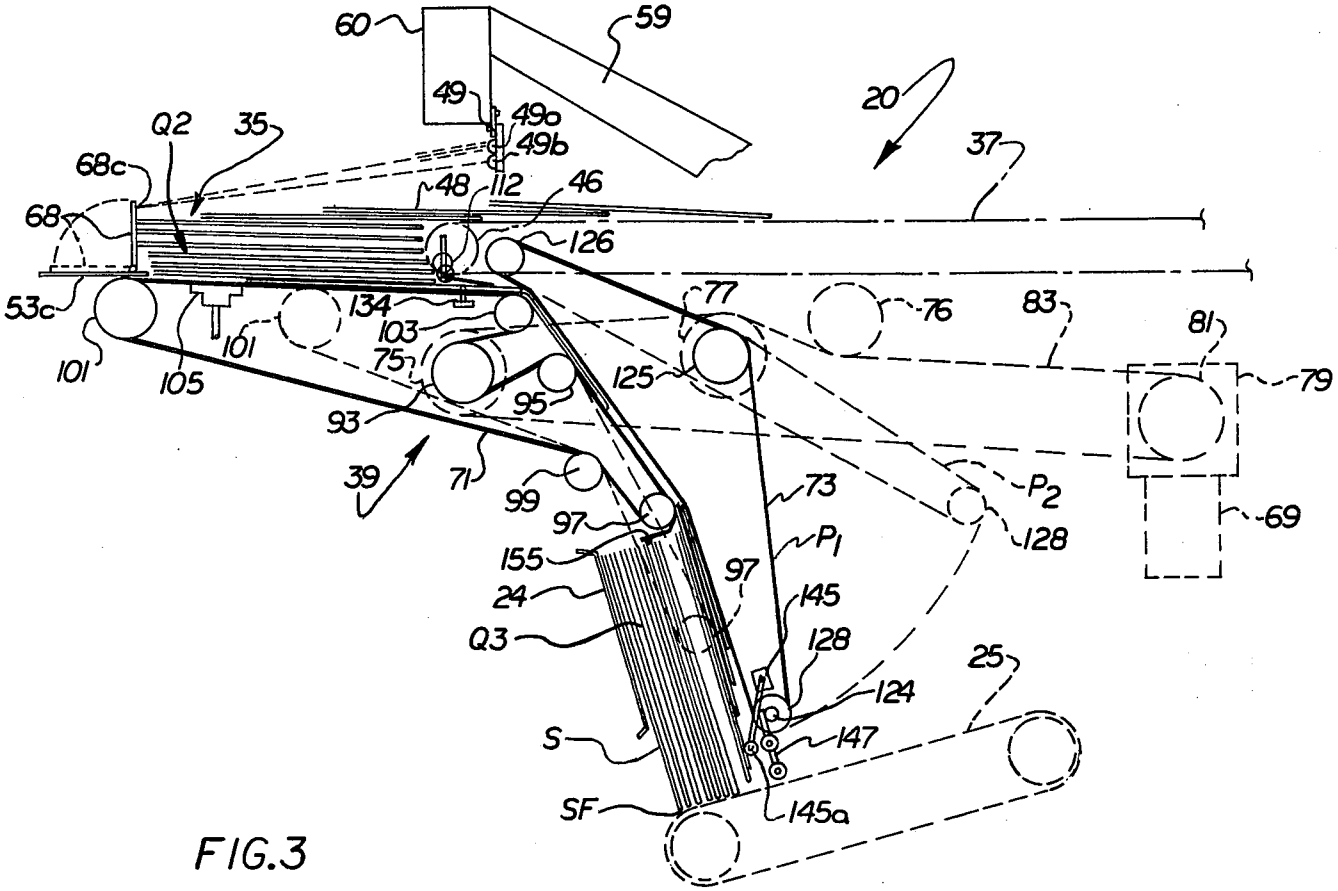
FIG. 3 is an enlarged, internal schematic view of FIG. 2 showing the signature conveyor belts, horizontal hopper, etc.

Motor 42 is energized when signatures S need be moved by belts 44*a* and 44*b* toward the left in FIG. 1*a* to satisfy need for more signatures S at belts 45, whose driving motor 43 is energized by sensing means 49 in FIG. 3 sensing need for feeding signatures S into hopper 35.

If desired, pack Q1 has its signatures S at loading position 33 generally horizontally oriented on a horizontal hopper loader, as shown in aforementioned '258 patent, instead of generally vertically as shown in aforementioned '191 patent. At loading position 33 in applicant's drawing FIG. 1*a,* signatures S would then have to be loaded in horizontal orientation on conveyor belts 44*a* and/or 44*b* with signature S folded edges SF facing toward the right in FIG. 1*a.*

Aforesaid '191 patent also discloses detector switch effective to initiate in-feed of signatures by a conveyor into a hopper when the level of signatures in its hopper falls below a predetermined level.

Sensing means 49 in FIG. 3 of the present drawings provides a comparable sensing or detection action, and is responsive to the thickness of pack Q2 of signatures S in hopper 35 for controlling in first feeding means 37 the intermittent drive of belts 45 by motor 43 for feeding signatures S into hopper 35, so that a preselected pack Q2 thickness of signatures S in hopper 35 is no exceeded.

Any suitable horizontal hopper loader, similar to loader 41, may be converter to loader 20 for inserting signatures S into generally vertical pocket P, by adding nose section or adapter 48 in FIG. 1*a,* instead of using a hopper and a detector switch in aforesaid '191 patent (or the equivalent structure in aforesaid '258 patent), with said adapter 48 including two side plates, hopper 35, second feeding means 39 and suitable controls therefor, including sensing means 49, as described hereinafter.

Figure 2:
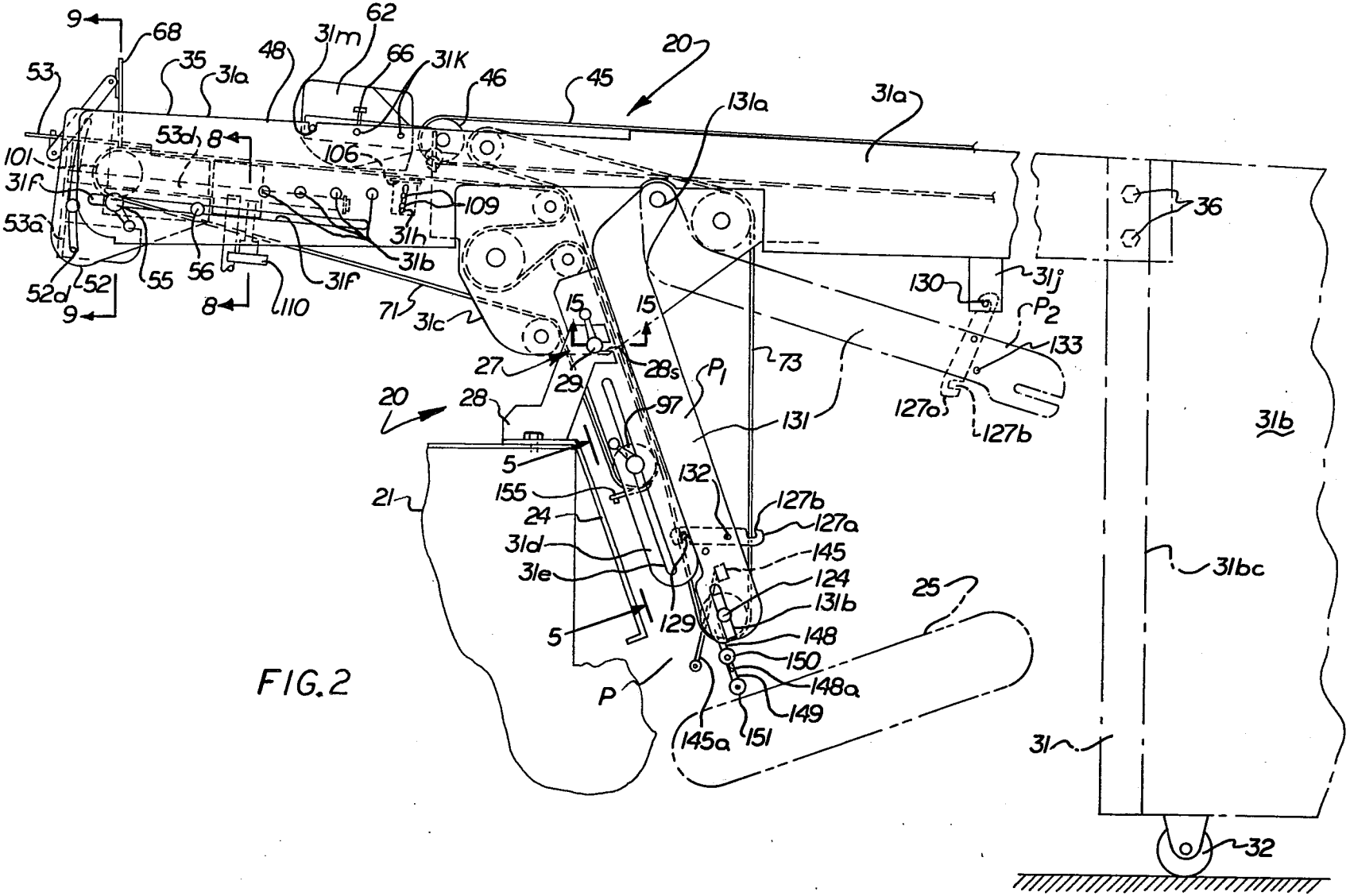
FIG. 2 is an enlarged side elevational view of a portion of the coupled loader and signature inserter in FIG. 1.

The frame and subframe structure of loader 20 will be described first in general and later in detail. In FIGS. 2, 4, 6, 6*a,* 9 and 10, wheeled main frame 31 has a plurality of interconnected parts, including two, parallel side plates 31*a* straddling conveyor belts 45 on opposite sides of frame 31; and supporting: (1) two side subframes 52 in FIG. 4 movable in generally horizontal adjustment along two, generally horizontal parallel slots 31*f* in side plates 31*a,* one of said slots 31*f* being shown in FIG. 2; and (2) connecting cross subframe 53 in FIGS. 2, 4, 9 and 10, supported by side subframes 52, having generally vertical, arcuate adjustment along two, parallel, arcuate slots 52*d,* one of which is shown in FIGS. 2 and 10.

Here is the detailed explanation of the frame and subframe structure.

Frame 31 has its base frame 31*b* attached to wheels 32, having at least two vertical structural corner columns 31*bc* at the two left corner edges of base frame 31*b* in FIG. 2, and secured to two parallel side plates 31*a* by bolt and nut connections 36 to columns 31*bc,* so that bolt and nut connections 36 support nose section or adapter 48 by its side plates 31*a* with bolt and nut connections 36 providing easy removal of nose section 48, if so desired. Each side plate 31*a,* as shown in FIG. 2, is connected to a connecting side plate 31*c* in turn secured to lower side plate 31*d* having inclined slot 31*e* therein.

Figure 9:
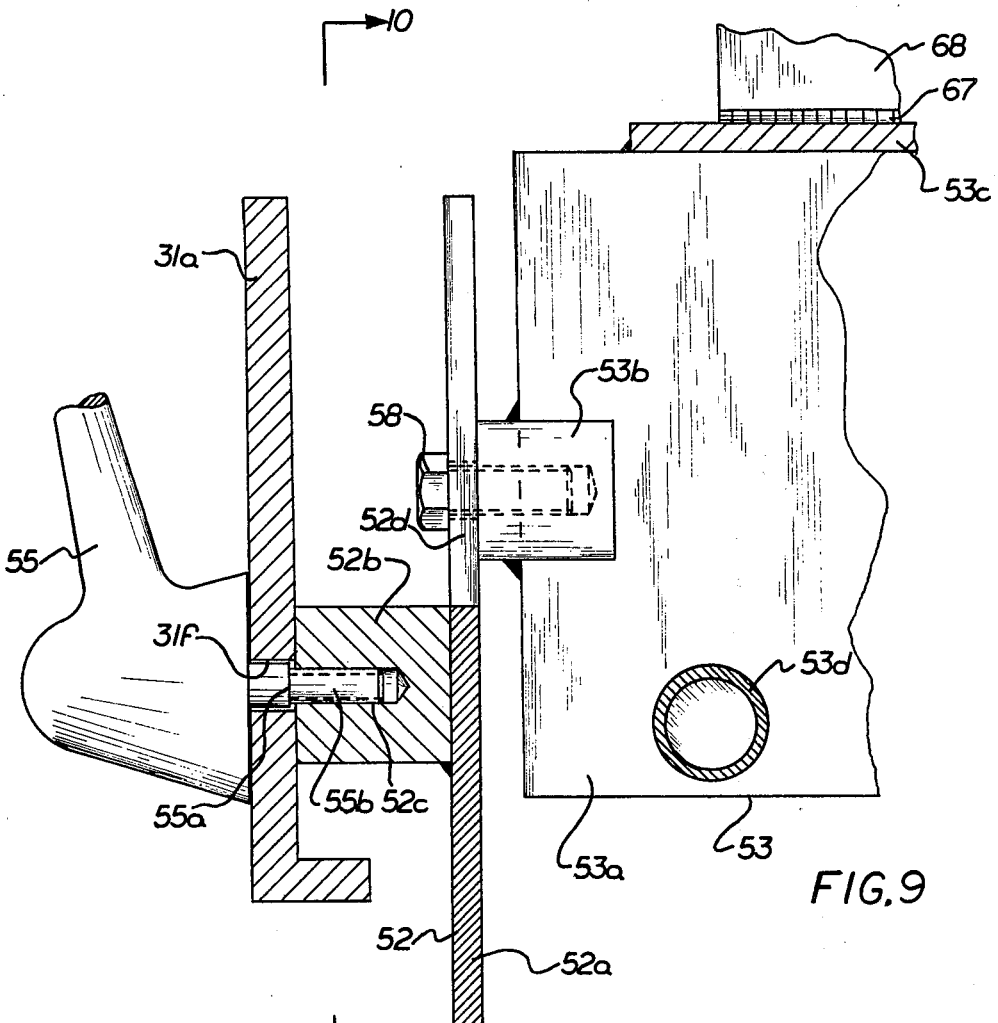
FIG. 9 is a vertical, transverse, sectional view taken generally along line 9—9 in FIG. 2 of numerous portions of the frame.
Figure 10:
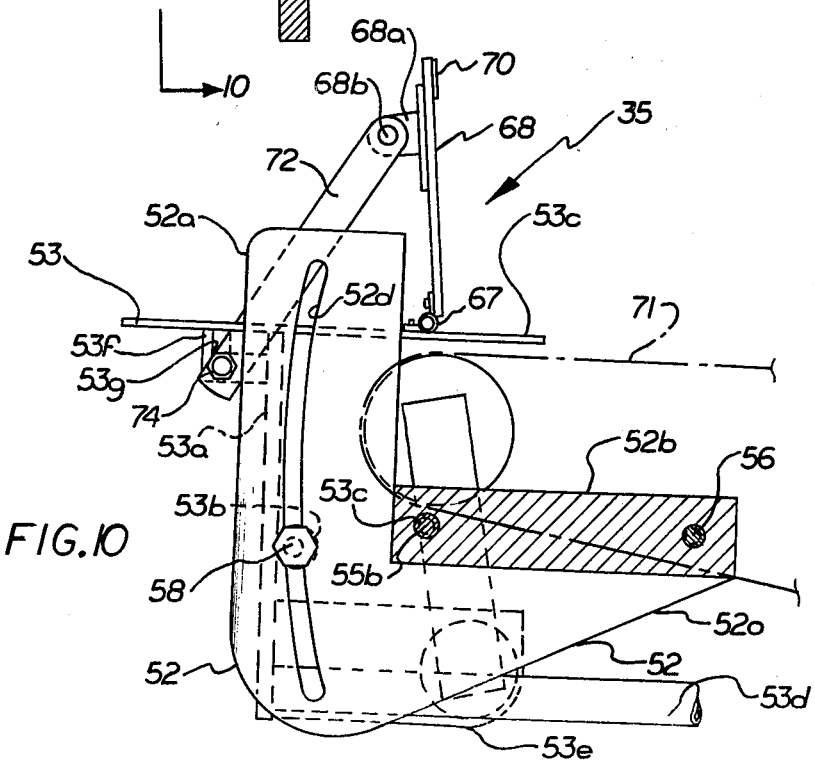
FIG. 10 is a vertical, longitudinal, schematic view taken generally along line 10—10 in FIG. 9.

Each side subframe 52 has, as shown in FIGS. 9 and 10, vertical plate 52*a* welded at its ends to two blocks 52*b.* Handle 55, integral with shoulder 55*a* and threaded end 55*b,* is screwed into threaded hole 52*c* in block 52*b.* Shouldered screw 56 is similarly screwed into block 52*b* in FIGS. 2 and 10. Shoulder 55*a,* and the shoulder on screw 56, are adapted to slide in generally horizontal slot 31*f* in FIG. 2 with subframes 52 and 53, even when screw 56 is fully screwed into block 52*b* since its shoulder is bearing directly against block 52*b.* Since shoulder 55*a* in FIG. 9 does not engage block 52*b* when threaded end 55*b* is fully screwed into block 52*b,* tightening handles 55 will lock two, side subframes 52 against endwise movement in slots 31*f;* and loosening both handles 55 will permit two, side subframes 52 to be moved along slots 31*f* by each shoulder 55*a* traveling in its associated slot 31*f* until a new position is reached, where side subframes 52 can be locked in the new position by tightening handles 55.

Figure 6:
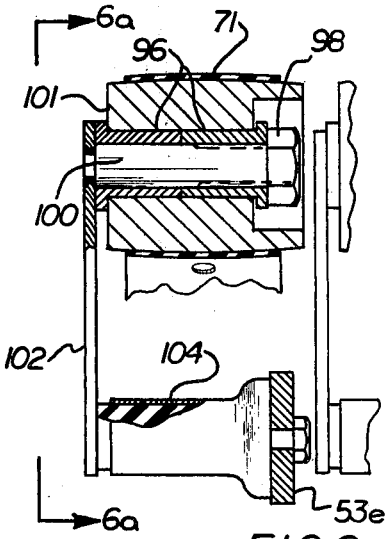
FIG. 6 is a vertical, transverse, sectional view taken generally along line 6—6 in FIG. 4 of the other end of the conveyor belts in FIG. 5.
Figure 6A:
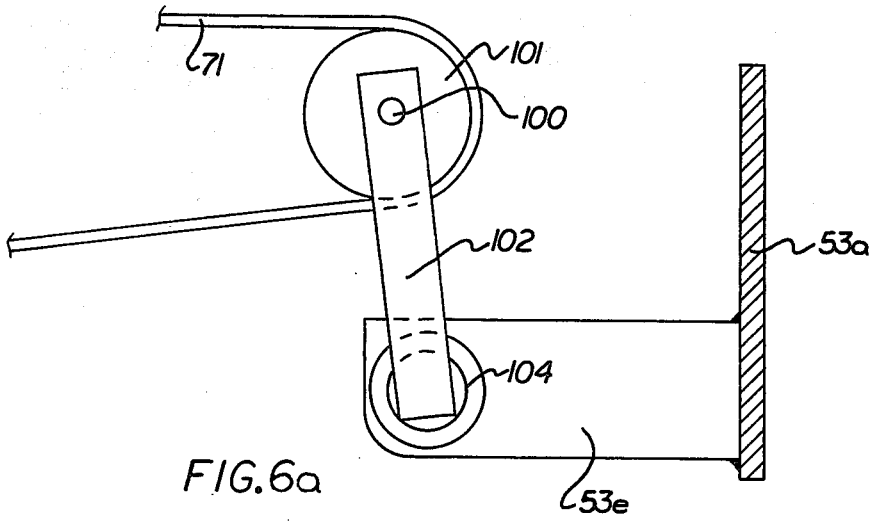
FIG. 6*a* is a vertical, longitudinal, sectional view taken generally along line 6*a*—6*a* in FIG. 6.

Connecting cross subframe 53 in FIGS. 2, 4, 9 and 10 has two sleeves 53*b,* one welded to each end of rectangular cross plate 53*a* to which is welded top plate 53*c* extending transverse of loader 20; two, parallel, longitudinal tubes 53*d;* and a plurality of longitudinally extending arms 53*e,* one of which is shown in FIGS. 6 and 6*a.* Opposite ends of cross plate 53*a* are adjustably secured by two screws 58, one extending through each arcuate slot 52*d* in FIGS. 9 and 10 and screwed into a threaded hole in one of the sleeves 53*b,* so that loosening of both screws 58 will permit movement of connecting, cross subframe 53 along arcuate slots 52*d* to a new, adjusted position thereafter maintained by tightening screws 58.

Electric control box 60 in FIGS. 1*a* and 3 has the electrical controls for the motors, etc. described herein for loader 20; is secured at the upper left end of two parallel arms 59, secured at their lower right ends to respective frame side plates 31*a;* and is secured to and supports sensing means 49.

Coupling means 27 is provided for operatively detachably coupling and decoupling in the FIG. 1*a* position wheeled frame 31 to some of the walls of generally vertically extending pocket P, namely the walls formed by face plate 24 and conveyor means 25 on inserter 21. In FIGS. 1*a,* 2 and 15, coupling means 27 includes at least one set of coupling elements comprising slot element 28*s,* pin element 29*c,* and clamping means 30 on coupling member 29 for detachably coupling elements 28*s* and 29*c* together, and preferably includes two sets of such elements 28*s,* 29*c,* clamping means 30, and coupling members 29 with one set on each side of frame 31 in FIGS. 1*a* and 2. Two interface brackets 28, each secured at its lower end to the top of inserter 21, have parallel slot elements 28*s* opening toward the right and extending parallel to supporting surface or floor F on which wheels 32 of wheeled frame 31 roll. Each of the two coupling members 29 has in FIG. 15 its: (1) threaded portion 29*b* screwed into horizontally extending threaded hole 31*g* in connecting side plate 31*c* of frame 31; (2) pin element or cylindrical portion 29*c* located at the proper height above floor F to be rolled by frame 31 up to, to enter and travel along slot 28*s* into the desired coupling position; and (3) handle 29a turnable for detachably locking or clamping elements 28s and 29c together in the coupled position shown in FIGS. 1a, 2 and 15 by clamping means 30, comprising handle 29a, threaded portion 29b and threaded hole 31g.

The advantages of this construction and coupling means 29 is that: (1) it requires only a short coupling and decoupling time to couple or uncoupling loader 20 relative to inserter 21; (2) no modification need be made in the supply hopper or pocket of inserter 21 since pocket P in FIG. 1a of the present drawings corresponds to inserter pocket or hopper in FIG. 1 of '255 patent earlier described; and (3) as many, or as few, signatures S, as desired, may be normally stored in pack Q3 in pocket P, depending upon where pin elements 29 are clamped in slot elements 28s along the length of slot elements 28s. Usually, it is desirable to have as few signatures S as possible in vertical pocket P, so that the sucker in inserter 21 has less friction to work against in pulling the lefthand signature S out of pocket P. This will minimize malfunctioning of the machine and improper feeding of signatures S individually onto saddle 18a in FIG. 1a. Also, the left ends of slot elements 28s can provide either a positive stop for pin elements 29 for accurately sizing pocket P or a starting point for a minimum size pocket P enlarging as pin elements 29 are clamped farther to the right in slot elements 28s if inserter 21 will work properly with more signatures S in pocket P.

Figure 14:
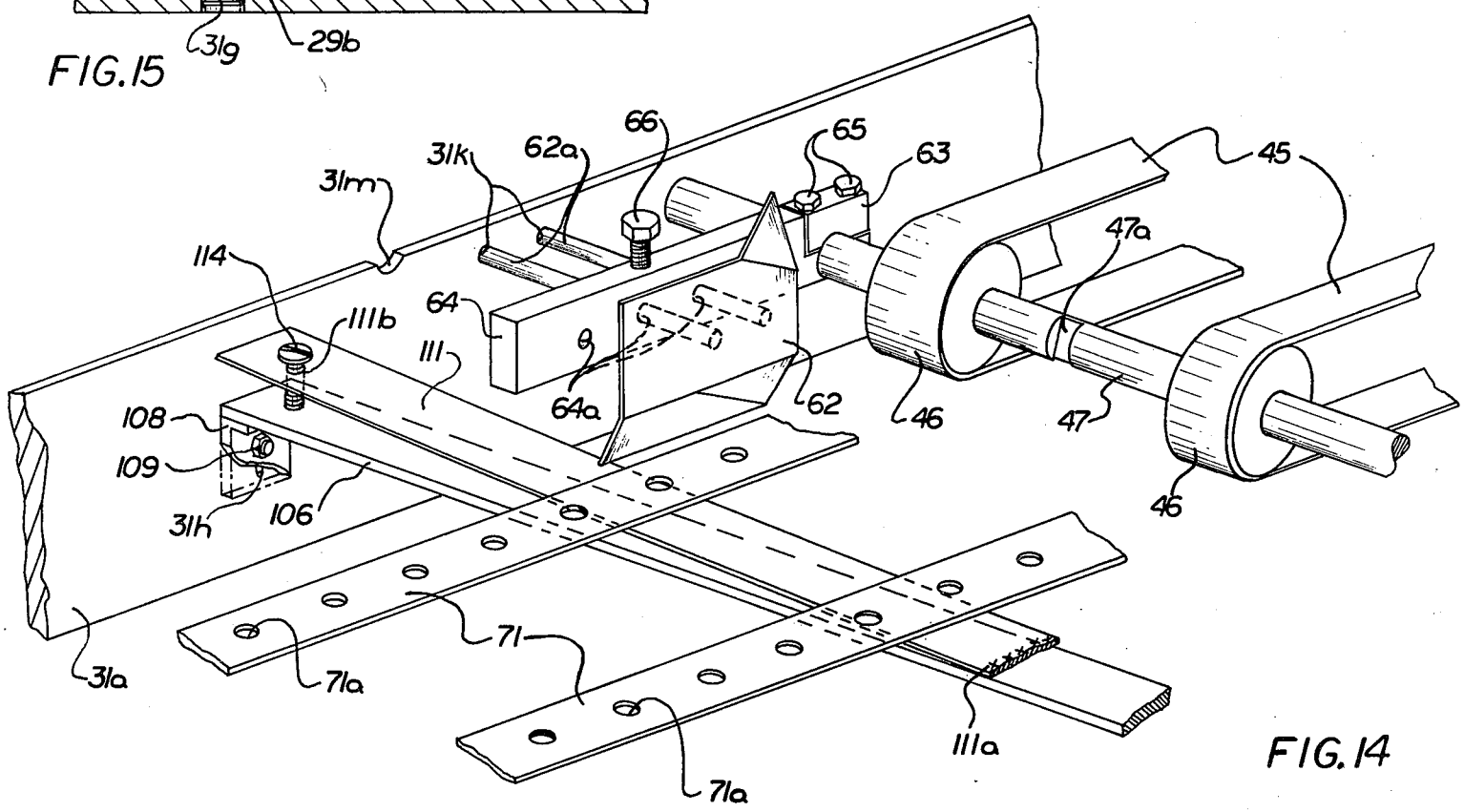
FIG. 14 is a generally schematic, partial perspective view taken slightly downwardly generally along arrowed lines 14 in FIG. 4 of the bowing plate for use in feeding light and weak signatures and of one of the side guides of the hopper.

Hopper 35 includes: (1) hopper backstop, signature stop or end wall 68: (a) pivotally mounted in FIGS. 3, 9 and 10 by hinge 67 onto cross subframe member 53 top plate 53c for stopping the travel of signatures S in the leftward direction in FIGS. 3, 4 and 10 into hopper 35; (b) has its signature stopping, solid line position determined in FIG. 10 by diagonal leg 72 pivotly secured at its upper end by pivot 68b on lug 68a secured to backstop 68, extending downwardly to the left through slot 53f in FIG. 4 in subframe top plate 53c, and detachably secured at its lower left end in FIG. 10 by leg 72 carrying a transversely extending pin or bolt and nut 74 dropping downwardly into slot 53g in lug 53f secured to the bottom of top plate 53c with bolt and nut 74 tightened in the bottom of, or at any other desired location in, slot 53g; and (c) movable to its generally horizontal, dotted line position for end wall 68 in FIG. 3 down on top of top plate 53c in FIG. 10 by pulling pin or bolt and screw 74 upwardly out of the open top end of vertically extending slot 53g in lug 53f, and permitting backstop 68 to pivot by hinge 67 downwardly onto top plate 53c; (2) a hopper bottom wall formed by suction manifold 105 and belts 71 of a conveyor means described in more detail hereinafter; and (3) opposite side guides 62 in FIGS. 4 and 14 each having secured thereto two rods 62a slidable in two of the three horizontal, transverse bores 64a in a longitudinally extending support base 64 having its righthand end detachably connected to stationary shaft 47 in FIGS. 4 and 14 by block 63 detachably secured to bar 64 by two screws 65. Stationary shaft 46 has along its length a pair of parallel flats 47a between each pair of rollers 46 thereon and complimentary in shape to the engaging surfaces of bar 64 and block 63, so that bar 64 and block 63: (1) can be detachably secured between any pair of rollers 46 on shaft 47 to vary the space between bars 64 and side guides 62, (2) will be locked against axial movement along shaft 47 to maintain any given selected space between bars 64, and (3) will be locked against rotational movement on stationary shaft 47 to maintain bars 64 parallel and generally horizontal. A clamp screw 66 is screwed into each bar 64 diametrically of its center bore 64a: (1) to clamp rod 62a in this center bore in any selected final width adjustment relative to bar 64, and (2) to permit two rods 62a to be removed from righthand two bores 64a in FIG. 14 and inserted into lefthand two bores 64a, if signatures S are longer and if hopper backstop 68 is moved farther to the left in FIG. 4, while each clamp screw 66 can still clamp one of the rod 62a in center bore 64a in a final width adjustment position. Each frame side plate 31a has two holes 31k and notch 31m in FIGS. 2 and 14 for permitting rods 62a to extend through side plates 31a to give side guides 62 adjustment to greater width.

Pivoting of hopper backstop 68 by hinge 67: (1) in the counterclockwise direction in FIG. 10 down onto top plate 53c permits access to, and removal of all signatures S then in hopper 35; and (2) to its upright position permits adjusting target spot 68c on backstop 68 at the desired light reflecting angle from light source 49a to strike photo electric cell 49b of sensing means 49 in FIG. 3 of the drawings to provide a sensing or detecting action responsive to the thickness of the pack of signatures S in hopper 35 for controlling the driving of the motor 43 in first feeding means 37 in feeding signatures S into hopper 35 so that a preselected thickness of pack Q2 of signatures S in hopper 35 is not exceeded by having any signatures S above this preselected thickness cut off light to photo electric cell 49b to de-energize driving motor 43 for conveyor belts 42, 44 and 45 in FIG. 1a. The solid line, backstop position in FIGS. 3 and 10 of hopper backstop 68 is at approximately the correct position to provide light target spot 68c on backstop 68 the desired reflecting angle for light from light source 49a to strike photoelectric cell 49b; but since backstop 68 may move out of this position slightly in the various hopper adjustment positions thereof, small strip of reflecting tape has been adhered to backstop 68 at target spot 68c on backstop 68, which reflecting tape contains prism-like reflecting particles that will reflect adequate light for actuating photoelectric cell 49b even through light target spot 68c may have moved during the adjustment of backstop 68 to a different position, either angularly or longitudinally.

Next is described second feeding means 39 on frame 31 for feeding a reshingled stream of signatures S from pack Q2 at loading or loaded position in hopper 35 (with folded signature edges SF leading out of hopper 35) sequentially from the bottom of hopper 35 by suitable conveyor means, such as included by and between conveyor belts 71 and 73; and by directing signatures S on folded edges SF downwardly into generally vertical extending pocket P. Belts 71 and 73 are driven in FIG. 3 by variable speed electric motor 69 (driving independently of conveyor belts 42, 44 and 45 by motor 43 in FIG. 1a) driven pulley 75 (and its driving rollers 93) for driving belts 71, and driven pulley 77 (and its driving rollers 125) for driving belts 73 through motor driven gear box 79, drive pulley 81, and driven belt 83 trained over pulleys 75 and 77 and rotatably mounted on connecting side plates 31d and pulleys 76 and 81 rotatably mounted in side frame members 31a, so belts 71 and 73 can convey between them a shingled stream of signatures S in FIGS. 2 and 3 from the outlet, righthand end of hopper 35 to the upper, inlet end of pocket P.

Belts 71 are trained in FIGS. 2 and 3 over driver rollers 93 and driven rollers 95, 97, 99, 101 and 103: (1)

with driven, crowned rollers 101 in FIGS. 6 and 6*a* being each rotatably supported on two half bearings 96 in FIG. 6 secured by a nut 98 on a stud or threaded shaft 100 welded or secured in some other manner at its other end to arm 102, secured at its lower end by coupling 104 to one of the arms 53*e* on connecting cross subframe 53 with a sleeve of each coupling 104 being made of elastomeric material to apply a torsional or resilient bias to its driven roller 101 to torsion its belts 71 separately from other belts 71; and (2) with the other driven rollers 95, 97, 99 and 103 being rotatably supported at opposite ends in frame lower and connecting side plates 31*d* and 31*c*.

Second feeding means 39 includes bottom feeding means for sequentially feeding signatures S individually off the bottom of pack Q2 of signatures S in hopper 35 in a reshingled stream into the inlet bight of belts 71 and 73 formed by rollers 103 and 126 in FIG. 3, after which belts 71 and 73 carry the shingled stream into pack Q3 in generally vertically extending pocket P with folded edge SF of each signature S leading. This bottom feeding means includes a plurality of conveyor belts or perforated stripper belts 71 forming the bottom of hopper 35; supporting signatures S in pack Q2 in loading or loaded position in hopper 35 with vacuum manifold 105, supported on tubes 53*d* of subframe 53; traveling over vacuum manifold 105 for successively extracting the bottommost signature S in hopper 35; arranging signatures S in a reshingled stream; and feeding the shingled stream of signatures S into metering gate 112 in a manner to be explained hereinafter.

Figure 11:
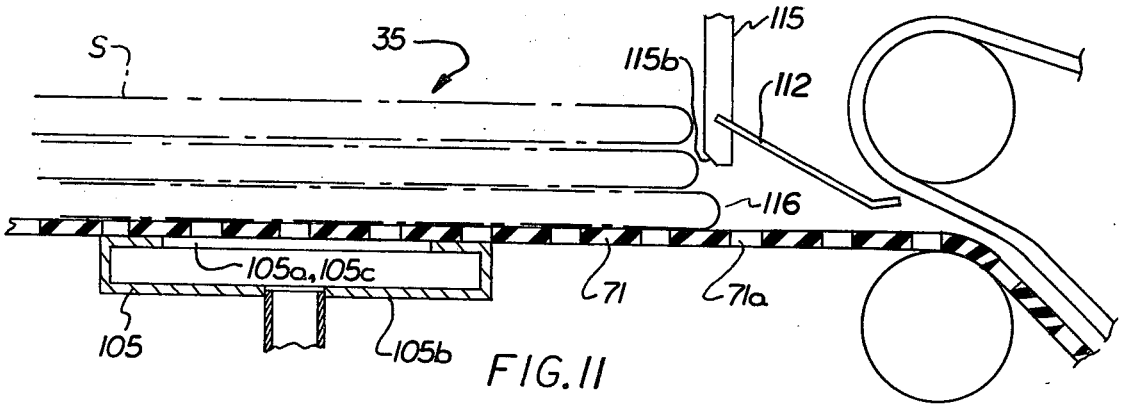
FIG. 11 is a vertical, longitudinal, schematic view taken generally along line 11—11 in FIG. 4 omitting some of the metering gate in FIG. 7.
Figure 12:
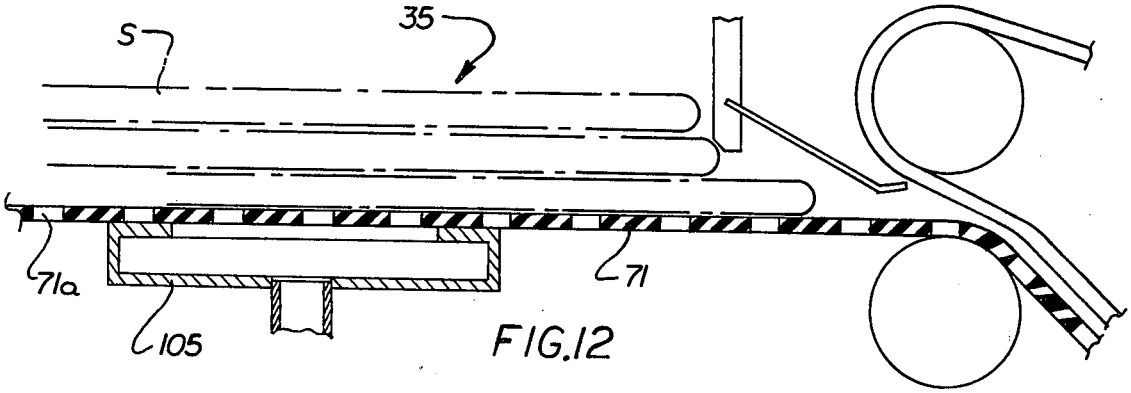
FIGS. 12 and 13 are vertical, longitudinal, sectional views, similar to FIG. 11, but with the shingled signatures at the bottom of the pack in the horizontal hopper progressively advanced toward the right as the perforated conveyor belt moves to the right.
Figure 13:
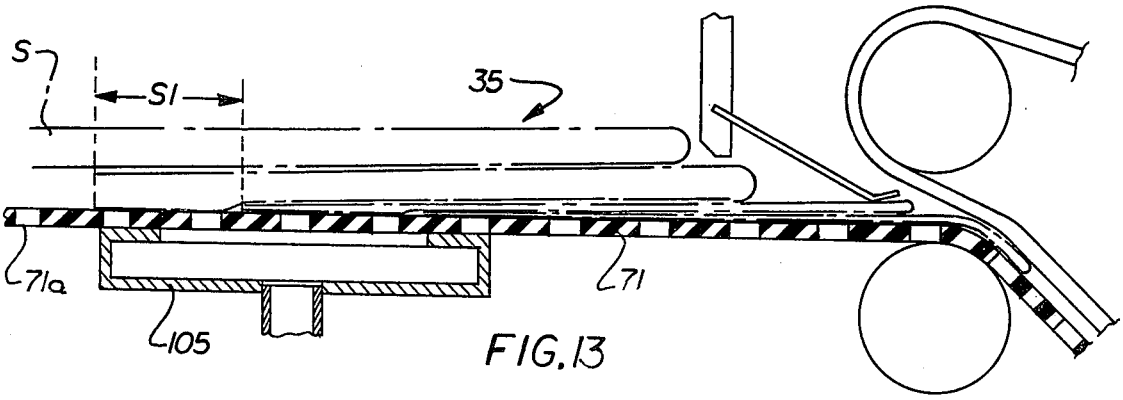

Belts 71 and manifold 105 provide dual functions of signature support in, and feed out of, hopper 35. Since hopper 35 is generally horizontally oriented, stack or pack Q2 of signatures S in hopper 35 loading position are supported by manifold 105 (secured by screws 110 in FIGS. 3, 4 and 8 to parallel tubes 53*d* in FIGS. 4, 9 and 10 on subframe cross plate 53*a*) and by endless stripper belts 71, which are also effective to apply suction to, and to feed out, the bottommost signature S in hopper 35. Belts 71 are juxtaposed on and in contact with rollers 101, 103 annd manifold 105; have perforations 71*a* in belts 71 operatively traveling over the inlets or suction mouths 105*a*, having one mouth 105*a* for perforations 71*a* in each belt 71, of vacuum manifold 105; and move sequentially the lowermost signatures S in hopper 35 progressively, as shown in FIGS. 11–13, toward the right and into the reshingled stream relationship, while signatures S are fed off the bottom of pack Q2 in hopper 35. Manifold 105 has back plate 105*b* and rectangular framing seal 105*c* around, and forming, suction mouths 105*a* to assure that negative pressure, or a vacuum, is maintained within suction mouths 105*a*. Stripper belts 71 move from left to right in FIGS. 11–13, and across suction mouths 105*a*; and their perforations 71*a*, in alignment with suction mouths 105*a*, pull lowermost signature S in FIG. 11 downwardly against stripper belts 71 and pulls this lowermost signature S off the bottom of the pack in hopper 35 and toward the right. This action continues as following perforations 71*a* move into alignment with suction mouths 105*a*. After lefthand edge of the lowermost signature S clears the lefthand edge of suction mouth 105*a* in FIG. 12, following perforations 71*a* in FIG. 13, as they come into alignment with suction mouths 105*a*, pull the next succeeding signature S from the bottom of hopper 35 down against belts 71 and advance it toward the right, and advance these signatures S in shingled fashion, spaced by overlap step S1 in FIG. 13, toward the right into, and through metering gate 112. Hence, signatures S are successively grabbed by suction off the bottom of the pack in hopper 35, extracted from hopper 35 and advanced through metering gate 112.

In the righthand portion of signature pack Q2 in hopper 35, signatures S are given support, and light and weak signatures are given added stiffness for feeding from the bottom of pack Q2 by transversely bowing signatures S, when desired. Flat base strip or mother plate 106 in FIGS. 2, 4 and 14 extends transversely under stripper belts 71 and pack Q2 in position 34 and is welded at each end to the top leg of an L-shaped bracket 108, having its vertical leg secured to a side plate 31*a* by two bolt and nut assemblies 109 in vertical slot 31*h* in side plate 31*a* to permit vertical adjustment of base strip 106 to a position for support of pack Q2 and then locking in that position by tightening all four bolt and nut assemblies 109. Any desired bowing is provided by thin bowing strip 111 welded at its mid-point 111*a*, normally biased to lie flat on base strip 106, and having at each end a threaded hole 111*b* with a vertical adjustment screw 114 having its lower end bearing against the top surface of base strip 106 to bow bowing strip 111 concave upwardly into the desired bowed position.

This provides a support surface on frame 31 bowed in a direction transverse to the direction of travel of the shingled signature stream and located below the bottom, or on the feed-off side, of pack Q2 in hopper 35 for bowing to give longitudinal stiffness to at least the bottommost light and weak signature S being fed from the bottom of pack Q2, and to prevent its bending over during feeding by stripper belts 71.

Figure 7:
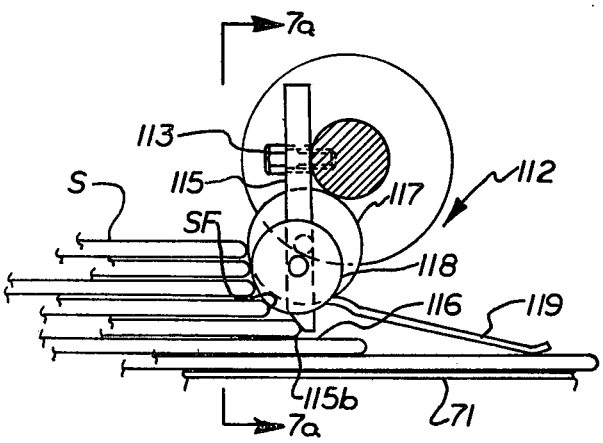
FIG. 7 is a vertical, longitudinal, sectional view taken generally along line 7—7 in FIG. 4 of a metering gate, perforated conveyor belt and associated signatures.
Figure 7A:
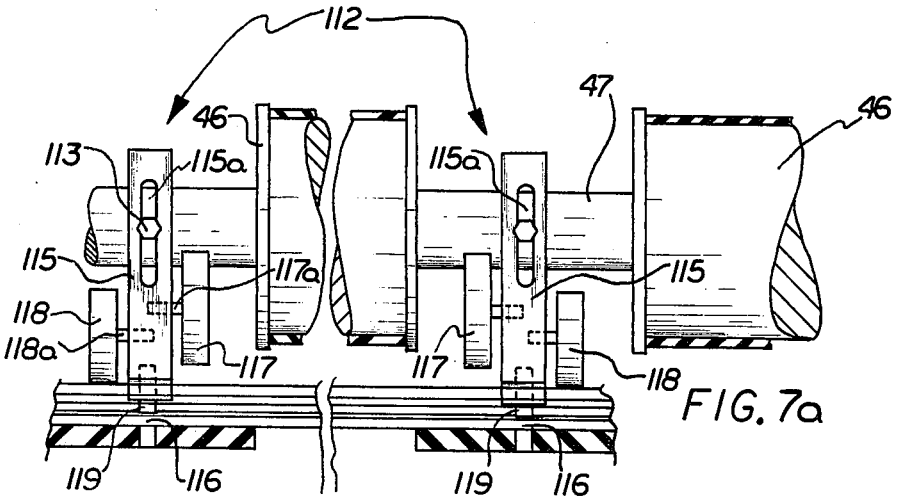
FIG. 7*a* is a vertical, transverse, sectional view taken generally along line 7*a*—7*a* in FIG. 7.

Metering gate 112 in FIGS. 3, 7 and 7*a* is spaced downstream from vacuum manifold 105 and loading position 34 of hopper 35, is at the discharge end of hopper 35, and is operatively associated with conveyor belts 71. Metering gate 112 includes two metering gate components, mirror images of each other, with each comprising downwardly extending gate member 115, mounted for vertical adjustment on stationary shaft 47 by screw 113, extending through its vertical slot 115*a* and screwed into a threaded hole on shaft 47; and a plurality of set up wheels 117, 118 respectively rotatably secured by integral stub axles 117*a* and 118*a* to gate member 115 and coacting with the leading edges of signatures S, carried by belts 71, upstream from gate member 115 for moving signatures S into reshingled stream relationship after signatures S are fed off the bottom of pack Q2 in hopper 35. As belts 71 move signatures S toward the right in FIG. 7, lead edges of signatures S lower in the pack will be advanced farther toward the right in FIG. 7 as they bear against peripheries of larger diameter set up wheel 117, smaller diameter set up wheel 118, and taper 115*b* on lower end of gate member 115, and then travel through opening 116 between the lower end of gate member 115 and belts 71; are held down by hold down finger 119 secured at its left end in FIG. 7 to gate member 115; and are conveyed into the bight of conveyor belts 71 and 73 in FIGS. 3 and 13.

Belts 73 in FIG. 3 are trained over rollers 125 (driven by pulley 77), rollers 126, and rollers 128, mounted on nonrotatable shaft 124 on arms 131. Rollers 125 and 126 are rotatably mounted and supported on opposite ends in connecting side plates 31*c*.

Local jam indicator switch 134 in FIG. 3 is secured by a suitable bracket to a frame side plate 31*a*; is actuated by a build-up, or jam, of signature S under hold down finger 119; and deenergizes driving motor 69 to stop conveyor belts 71, 173 after a jam has occurred.

The lower ends of belts 73 are supported by two parallel swing arms 131, each pivotally mounted in FIG. 2 at its upper end by pivot 131*a* to one of the side plates 31*c;* has at its lower end slot 131*b* for slidably mounting one end of shaft 124, rotatably mounting rollers 128, for permitting endwise adjustment of shaft 124 in parallel slots 131*b* for adjusting rollers 128 and the tension of clamp belts 73 and for locking shaft 124 at the selected belts tension by a lock screw 123 screwed axially into each end of shaft 124 to clamp it into slots 131*b;* can swing counterclockwise in FIG. 2 with the lower ends of belts 73 from the solid line position P1 to the dashed line position P2 to clear any jams of signatures S between belts 71 and 73 and to get into pocket P, while maintaining the fixed geometry of belts 73 over its rollers 125, 126 and 128; and has latch 127 adapted to detachably secure an arm 131 in position P1 by engaging pin 129 secured to frame lower side plate 31*d* or in position P2 by engaging pin 130 secured to lug 31*j* on a frame side plate 31*a*. Latch 127 is pivotally mounted off-center to arm 131 by pivot pin 132, and is gravity biased by this off-center mounting to stop against stop pin 133 on latch 127. As arm 131 is swung between these positions P1, P2 and latch 33 engages stop pin 133, one of the inclined camming edge 127*a* on latch 127 is aligned with one of the pins 129 or 130 and is cammed over the pin, and one of the notches 127*b* on latch 127 is gravity biased into detachable latching engagement with this pin.

The shingled stream of signatures S, held captive between belts 71 and 73, is not materially disturbed during signature travel from outlet of metering gate 112 (at hold down finger 119) and around rollers 103 since the diameters of driven pulley 77 in FIG. 3 driving rollers 125 for belts 73, relative to the diameters of driven pulley 75 driving rollers 93 for belts 71, are so chosen that belts 73 have a speed about 7% greater than belts 71 around rollers 103, so signatures S have no riffling, sliding or jostling action around rollers 103.

Figure 15:
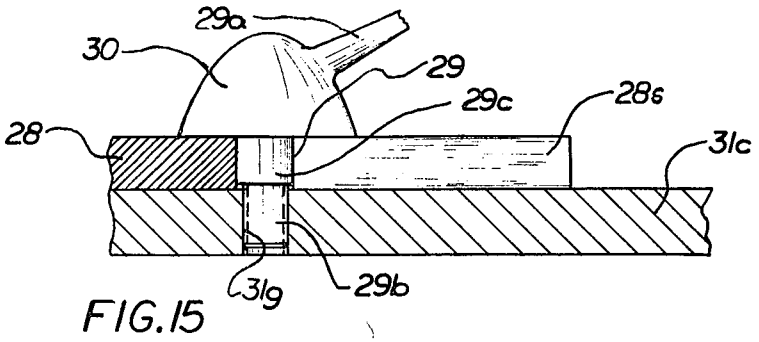
FIG. 15 is a generally horizontal, partial sectional view taken generally along line 15—15 in FIG. 2 of the coupling means for coupling the signature loader and inserter.

After coupling means 27 in FIGS. 1*a*, 2 and 15 has coupled together loader 20 and signature inserter 21 to form unit 19 and pocket P, conveyor belts 73 extend in FIG. 3 at rollers 128 below rollers 97 of belts 71, so belts 73 feed signatures S in the shingled stream inside the inlet, righthand side wall of vertically extending pocket P, formed with other pocket P walls, including face plate 24 and feed rack inserter 25.

Hopper 35 has these three adjustments.

First, hopper 35 has adjustable mounting means for hopper tilt. The lefthand portion of hopper 35 in FIGS. 2 and 3 supporting the fed-in lead edges of signatures S in hopper 35 can be lowered, or raised, relative to the feed-in path of signatures S entering the righthand portion of hopper 35 by first feeding means 37. In a lowered position, since signature open edges SO are the leading edges fed into the hopper, the normal opening action of signatures S in hopper 35 will not interfere with the feed-in of following signatures S by first feeding means 37; and during signature feed into hopper 35, the following signature open edge SO will not straddle over preceding signature folded edge SF then in hopper 35. Loosening two bolts 58 in FIGS. 4 and 9 on opposite ends of cross plate 53*a* permits connecting cross subframe 53 to be lowered or raised by having bolts 58 travel in arcuate slots 52*d* in FIGS. 2 and 10. Cross subframe 53 carries with it top plate 53*c* and hopper backstop 68 forming respectively the lefthand portion of the bottom wall of hopper 35 in FIGS. 2, 3, 4 and 10 and the lefthand, end wall of hopper 35. The lowered or raised left end of hopper 35 can be locked in any selected position along the length of slots 52*d* by tightening bolts 58. Sensing means 49, having the light rays from light source 49*a* reflecting off hopper backstop 68 to actuate photoelectric cell 49*b*, is responsive to the thickness of signature pack Q2 in hopper 35 in hopper loading position for controlling first feeding means 37 through its motor 43, so that not only a preselected pack Q2 thickness of signatures S in hopper 35 loading position is not exceeded but also following signature open edges SO entering hopper 35 do not straddle over preceding signature folded edge SF already in hopper 35 and against hopper backstop 68.

Second, hopper 35 has suitable adjustment for width of signatures S. The adjustment for width of two side guides 62 in FIGS. 4 and 14 has been earlier explained by reference to selection of suitable pairs of parallel flats 47*a* on stationary shaft 47, securement of support bars 64 to these flats by blocks 63 and bolts 65, and side guide rods 62*a* adjustment in bores 64*a* and clamping at the desired positions by clamp screws 66.

Third, hopper 35 has suitable adjustment for length of signatures S. Hopper 35 can be adjusted for longer signatures being fed by: (1) moving two side guide rods 62*a* of each side guide 62 in FIG. 14 from the righthand two bores 64*a* to the lefthand two bores 64*a* to move two side guides 62 farther away from discharge feed rollers 46 in FIG. 14 of first feeding means 37; and (2) moving hopper backstop 68 toward the left in FIGS. 2, 3, 4 and 10 by loosening two handles 55 in FIGS. 4 and 9, and by sliding two side subframes 52 generally horizontally by having shoulder 55*a* in FIG. 9 and shouldered screw 56 travel to the left in FIG. 2 in generally horizontal slots 31*f* to a new position suitable for longer signatures S with this position maintained by tightening handles 55. Hence, hopper end wall or backstop 68 is adjustable longitudinally relative to the remainder of hopper 35 for permitting hopper 35 to receive different length signatures S. Backstop 68 serves as a signature feed-in stop, adjustably mounted on frame 31 and movable relative to signatures pack Q2, for permitting pack Q2 to have different length signatures S therein.

During the tilt and length adjustments for hopper 35 mentioned in the preceding paragraphs, belts 71 are maintained at proper tension by having driven roller 101 in FIGS. 2, 3, 4, 6 and 6*a* for each stripper belt 71 simultaneously movable with cross plate 53*a* of cross subframe 53, such as when lengthening hopper 35 from minimum to maximum length signatures S by moving driven rollers 101 from the dotted to the solid line position in FIG. 3. In any such adjustment of driven rollers 101, it may be desirable to adjust all rollers 97 simultaneously, such as by a similar movement from the dotted to the solid line positions in FIG. 3 from minimum to maximum length signatures S, to maintain the same, or to establish a new, tension on belts 71. Rollers 97 are spaced along shaft 135, and each is held against endwise movement on shaft 135 in FIG. 5 by straddling C-snap rings 136 snapped into grooves on shaft 135. Shaft 135 is: (1) restricted against substantial endwise movement by having two split collars 140, detachably secured by their tangential tightening screws 141 on opposite ends of shaft 135, located between two frame lower side plates 31*d;* (2) guided during sliding along length of two slots 31*e* in two side plates 31*d*: (a) by two guide screws 137, each screwed into a screw hole 140*b* in a shaft collar 140 and having its cylindrical portion 137*a* traveling in one of the slots 31*e*, and (b) by two handles 139, each having cylindrical portion 139*b* traveling in one of the slots 31*e*; (3) prevented from rotating by cylindrical portions 137*a* and 139*b* spaced along the lengths of slots 31*e*; and (4) secured in any selected adjustment position along the lengths of slots 31*e* by rotating handles 139, so that their threaded portions 139*a* advance in screw holes 135*c* in shaft 135 causing the heads of handles 139 to firmly clamp lower side plate 31*d* against shaft collars 140. Also, torsionally resilient couplings 104, one of which is shown in FIGS. 6 and 6*a*, individually bias the separate rollers 101 to maintain tension resiliently and independently on each of their respective individual stripper belts 71.

Arcuate slots 52*d* in FIGS. 2 and 6 are so designed that the left end of hopper 35 in FIGS. 2 and 3 can be raised or lowered without requiring readjustment of rollers 97 to maintain the tension on belt 71.

It is desirable that all signatures S in hopper 35 be approximately vertically aligned before feed out by second feeding means 39. After being fed into hopper 35 by first feeding means 37, signatures S are in a generally horizontal array and have approximately the same vertical orientation of their lefthand folded edges SF, such as against hopper backstop 68, so that second feeding means 39 will feed each signature S from the same starting point to get consistent signature S feeding by vacuum manifold 105 and perforated stripper belts 71, shingling, and feeding into and out of pocket P, through signature inserter 21 and down onto saddle 18*a* in FIG. 1*a*. This requires that signatures S consistently hit hopper backstop 68, which requires a specific alignment of hopper 35 relative to the horizontal, herein defined as a "generally horizontally oriented" hopper, as set forth hereafter in this paragraph. Signatures S may not consistently hit hopper backstop 68 if hopper 35, and its signatures S therein, were tilted at too great an angle in FIGS. 2 and 3 inclined: (1) upwardly to the left, since each signature S entering hopper 35 would not have sufficient driving force, after leaving belts 45 and rolls 46, to climb the hill created by, and to scrape frictionally over, preceding signature S in hopper 35 and to reach hopper backstop 68; or (2) downwardly to the left, since each signature S would not have sufficient support, would bend and may have its nose droop to create undue frictional drag, so such signature S might not reach hopper backstop 68. The desired angle of hopper 35 depends on these characteristics of pack Q2 of signatures S in hopper 35—the speed of in-feed belts 45, providing driving momentum to each signature S fed into hopper 35; the frictional surface qualities of signatures S, resisting movement of in-fed signature S over the top of top signature S in hopper 35; the length and width dimensions of signature S, since a large signature droop or frictional drag may have to be compensated for, since the amount of droop would be determined by signature S length and width dimensions, determining stiffness and droop of each signatures; and by the thickness of signature pack Q2 in hopper 35, since a thinner pack Q2 would require a greater drop by fed in signature S and cause a greater signature droop; and tightness of the fold on signature folded edges SF, which depends on the thickness and stiffness of the sheets making up signatures S. In feeding signatures S into hopper 35 by belts 45, it has been found that: (1) if the fold is tight, the hopper angle may be a slight upward to the left slope of about 3 degrees above the horizontal; but (2) if signature folded edge SF tends to open, and is not tight and is thick, the angle of hopper 35 may have even a greater slope, as much as 10 degrees, upwardly to the left above the horizontal, to allow for the greater thickness of signature pack Q2 at thick signature folded edges SF compared with at signature open edges SO and to permit the top surface of partially opened top signature S in signature pack Q2 in hopper 35 to be approximately horizontal.

In shingled signature feed in FIGS. 11–13 by second feeding means 39, the length of shingled signatures overlap step S1 in FIG. 13 can be varied, or maintained constant, by the positioning of the vacuum manifold 105. Manifold 105 is movable:

(1) independently of, and relative to, hopper backstop 68 to adjust or vary the length of signature overlap step S1 in FIG. 13, or reshingled relationship, fed from the bottom of hopper 35, as well as (2) with hopper backstop 68 to allow for variation in signature length while maintaining constant the selected length overlap step S1, or degree of overlap, since manifold 105 on tubes 53*d* can be moved to the left or the right either along with, or relative to, tubes 53*d* connected rigidly by cross plate 53*a* to backstop 68. These numerous adjustments assure that an overlap step S1 adjustment can be selected for each type and length signature, so that only one signature at a time is extracted and fed in an overlapped relation with the preceding signature, even though an adjustment which would produce a desired stream for one type signature is not necessarily the adjustment for another type signature. Hence, it is possible to handle a wide variety of signature sizes and qualities by these adjustments and still get proper feed into generally vertically extending pocket P in FIG. 1*a*.

Figure 8:
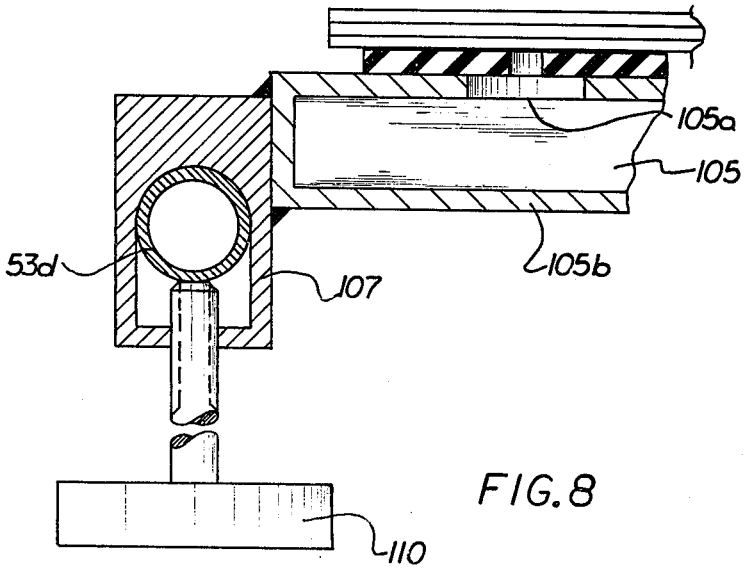
FIG. 8 is a vertical, transverse, sectional view taken generally along line 8—8 in FIG. 2 of an adjustable mounting for a vacuum manifold.

Adjusting or varying overlap step S1 will be first described. Means is provided for adjustably mounting vacuum manifold 105 and conveyor belts 71 on frame 31 for movement into different positions relative to hopper backstop 68, horizontally along the signature discharge path from hopper 35 in FIGS. 11–13, or in the direction of movement of the shingled signature stream, for allowing for variations in signature size and overlap in this direction of movement and for adjusting length of signature overlap stop S1 in FIG. 13, or the degree of signature feeding or reshingling action. Manifold 105 is welded to two brackets 107 telescoped over two parallel tubes 53*d* in FIGS. 4, 9 and 10, each secured at one end to subframe 53 cross plate 53*a*. Each bracket 107 is detachably secured to its associated tube 53*d* by clamp screw 110 screwed into a threaded hole in its bracket 107, as shown in FIG. 8, so that manifold 105 can be moved to the left or to the right in FIG. 4 and clamped by screws 110 in different positions on tubes 53*d*. If manifold 105 is moved to the right in FIGS. 4 and 11–13, there will be less overlap on signatures S fed from the bottom of hopper 35 into metering gate 112; and if manifold 105 is moved to the left, there will be more overlap, or a greater length overlap step S1 in FIG. 13. Hence, this adjustable mounting is used for adjusting the degree of signature S reshingling action and the variation in overlap step S1 in the direction of signature movement.

Figure 4:
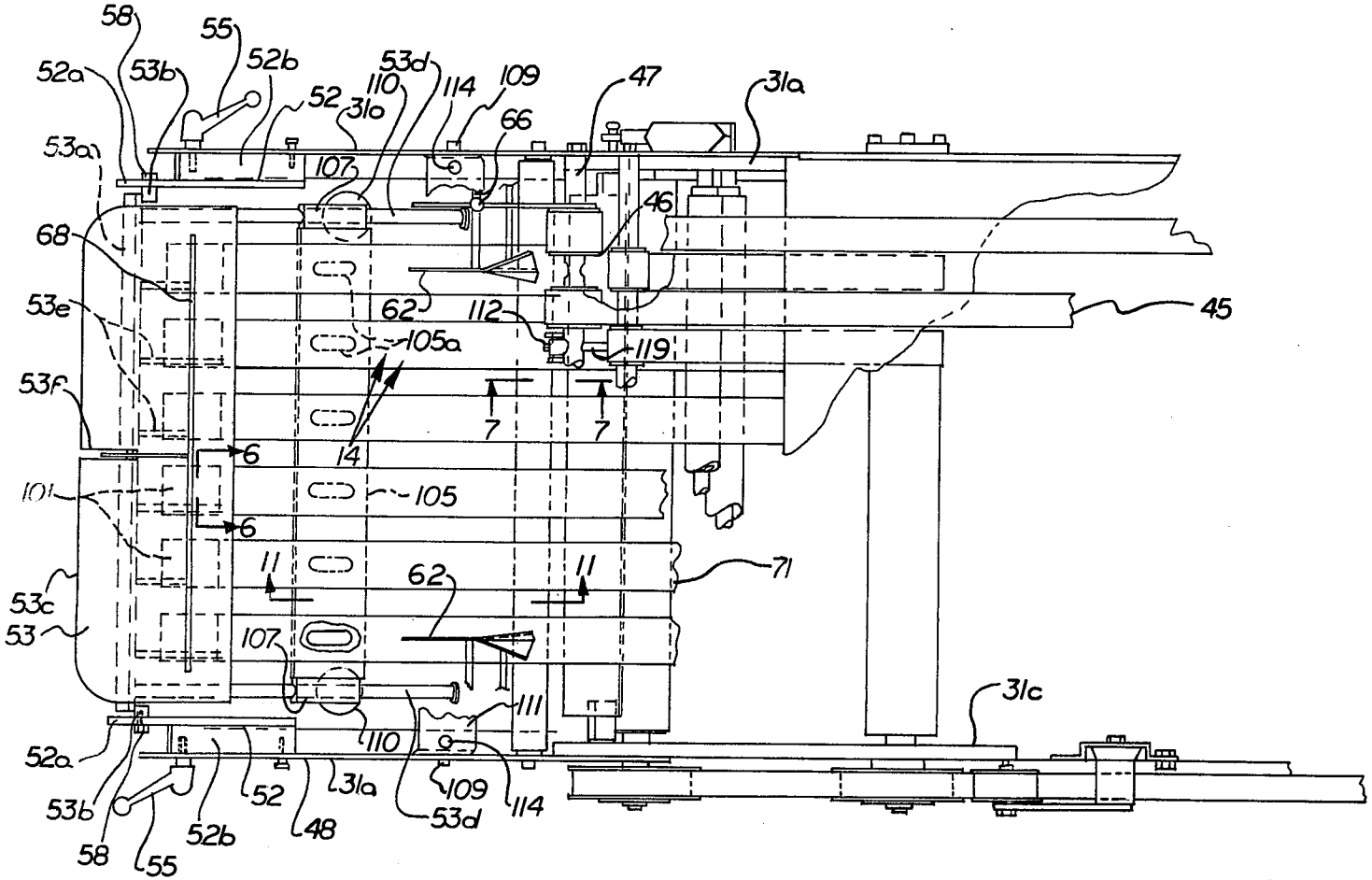
FIG. 4 is a top plan view of the lefthand portion of the loader in FIG. 2.
Figure 5:
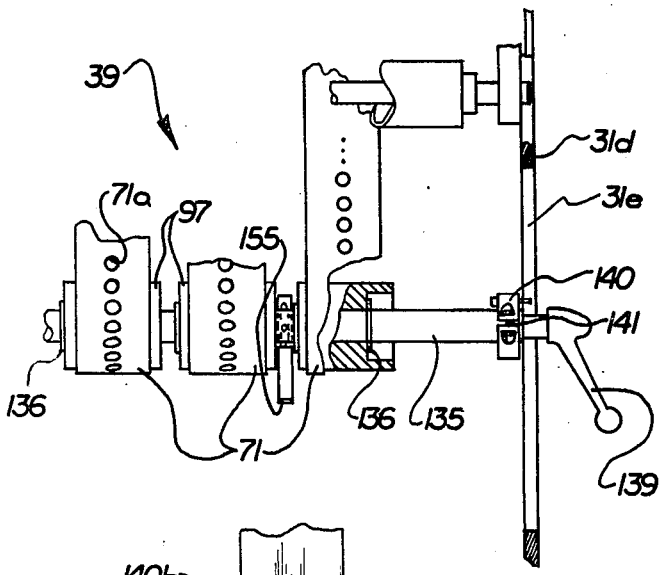
FIG. 5 is a partial, sectional view taken generally along line 5—5 in FIG. 2 of the adjustable lower end of one set of conveyor belts and through the generally vertically extending pocket.

Overlap step S1 can be maintained constant, while hopper 35 is adjusted in length to receive a different length signature S. In the aforementioned third hopper adjustment as to length of signatures S, hopper backstop 68 can be moved horizontally in FIGS. 2, 3 and 10, so that hopper 35 can accommodate different length signatures S, while maintaining the same length overlap step S1 in FIG. 13 between open edges SO of signatures S, sequentially fed from the bottom of hopper 35 by the coaction of suction manifold 105 and perforations 71*a* in stripper belts 71. In this adjustment, after handles 55 in FIGS. 2, 4 and 9 are loosened so that shoulder 55*a* and shouldered bolts 56 in FIGS. 9 and 10 can travel generally horizontally along slots 31*f* in FIGS. 2 and 9, cross subframe 53 can move in the same generally horizontal direction, and maintain the same length overlap step S1 in FIG. 13, by carrying with it: (1) two parallel tubes 53*d* in FIGS. 4, 8, 9 and 10 to which are secured vacuum manifold 105, and (2) top plate 53*c* and backstop 68 respectively forming the lower left bottom and left end portions of hopper 35 in FIGS. 3 and 9. Means is thus provided for simultaneously moving vacuum manifold 105 and signature stop or hopper backstop 68 for maintaining the same length overlap step S1 in the shingled stream of signatures S for different length signatures S.

Consideration of FIGS. 3, 7 and 11–13 shows the travel of signatures S into, in and out of hopper 35 and during feed into shingled relationship between belts 71, 73. In FIG. 3, hopper backstop 68 is located within a fairly close distance tolerance from rollers 46 for a given length signature S, so as to permit in-fed signatures S to stop precisely against hopper backstop 68 and still drop into hopper 35, but not with too much clearance to permit signature S edges SO to move substantially away from backstop 68 and out of vertical alignment, which would tend to cause erratic feeding and shingling of signature S thereafter. In FIGS. 11–13, although feed belt perforations 71*a*, coacting with manifold 105, create a shingled relationship of lowermost signatures S as they are fed from the bottom of pack Q2 in hopper 35, the purpose of this vacuum feed is not to establish the final shingled relationship of signatures S traveling between belts 71, 73. The vacuum feed is intended to feed the bottommost signatures sequentially, to give an additional feeding bite on bottom signature S in hopper 35, to feed it individually toward the right, to shingle signatures S and to meter or restrict to be sure that a group of signatures S do not try to go through metering gate 112 simultaneously. To improve this feeding action if signature S longitudinal strength is weak, vacuum manifold 105 in FIG. 13 is moved farther to the right and closer to metering gate 112 to increase overlap step S1. Metering gate set up wheels 117, 118 in FIG. 7 engage signature folded edges SF; and as seen in FIGS. 3 and 7, hold back upper signatures S from sliding forward toward the right with the bottom signatures, fan out signature backbones or folded edges SF, and give a slight pre-shingling relationship to signatures S before they are fed under gate member 115 in FIGS. 3, 7 and 11–13. Although a shingled relationship of signatures S is formed by feed belt perforations 71*a* coacting with manifold 105 and by setup wheels 117, 118, as mentioned heretofore in this paragraph, the final shingled relationship of signatures S entering between belts 71, 73 is formed as signatures S travel toward the right against taper 115*b* on the lower end of gate member 115, through opening 116 between the lower end of gate member 115 and belt 71, and under hold down finger 119.

There are numerous advantages in using loader 20, including generally horizontally oriented hopper 35 and signatures S therein, instead of the machine in the earlier mentioned Bewersdorf et al. patents. Present loader 20 solves many problems found in the prior art, and adds many new desirable operating features, especially as to the Bewersdorf et al. patents.

Loader 20 permits a large quantity of signatures S in FIG. 1*a* to be loaded on horizontal belt 42 without interfering with the desired feeding action, since sensing means 49 in FIG. 3 of the present drawings limits the number of signatures S in hopper 35 to give accurate signature feeding and shingling therefrom by second feeding means 39.

Suction manifold 105 supports only a relatively small height of signatures S in hopper 35, and suction holes 105*a* are directly in manifold 105, and only one suction hole 105*a* need be provided for each stripper belt 71, and simpler structure is obtained. This results in hopper 35 being able: (1) to run shorter signatures, since minimum size signature is determined by minimum horizontal size of manifold 105 in FIGS. 3 and 4; and (2) to handle both short and long signatures with minimum length hopper 35 added to length of loader 20. Means for supporting signatures S in hopper 35, including suction manifold 105 in FIGS. 3, 8 and 11–13; base strip or mother plate 106 in FIGS. 2, 4 and 13; and top plate 53*c* to the right of hopper backstop 68 in FIGS. 3, 4 and 10 provides additional advantages, including use of bowing plate 111 for feeding weak signatures, and permitting reaching in to clear jams by flexing belts 71 in any of the spaces between the multiple support parts. If longer signatures S are used, one or more auxiliary supports can be located longitudinally between top plate 53*c* and base strip or mother plate 106 of bowing strip 111; can be secured to opposite frame side plates 31*a* and be constructed similar to mother plate 106, L-shaped brackets 108, bolt and nut assemblies 109 and frame side plate vertical slots 31*h*, or by having only a hole in the side plate and locating the vertical slot in the L-shaped bracket. Four pairs of holes 31*p*, one of each pair shown in FIG. 2, are provided in side plates 31*a* for such auxiliary supports. The portion of top plate 53*c* in FIG. 10 to the right of hopper backstop 68 provides not only this signature support but also prevents belts 71 from pulling signature open edges SO downwardly and to the right away from hopper backstop 68 and prevents signatures S from sliding to the left under backstop 68. If one wants to have less of the weight of signatures S in hopper 35 carried by one or all of these supports, or to eliminate the need for any one or all of the aforementioned auxiliary supports, the load on the supports can be reduced by adjusting inwardly hopper side guides 62 in FIGS. 4 and 13 and tightening their clamp screws 66, so as to increase frictional contact between side guides 62 and signatures S to partially support, and to impede downward movement of, signatures S in hopper 35. Here, an adjustment means, including clamp screw 66, operatively connect side guides 62, straddling pack Q2 of signatures S, to frame 31 for adjustment inwardly to support at least part of the weight of pack Q2 and to take some of its weight off perforated conveyor belts 71 and vacuum manifold 105 during feeding of the shingled stream of signatures S.

Loader 20 avoids the riffling, sliding or jostling action of signatures between conveyor belts tending to damage signatures, and especially signature folded edges. This action tends to loosen folded edge and/or to create a second folded edge in the signature spaced from the original folded edge, so as to adversely deposit signatures on conveyor means or feed rack inserter 25 and/or saddle 18*a* in FIG. 1*a* by having the signature flopping down onto or jamming up feed rack inserter 25 and/or dropping with the wrong fold in alignment onto saddle 18*a*.

Figure 5A:
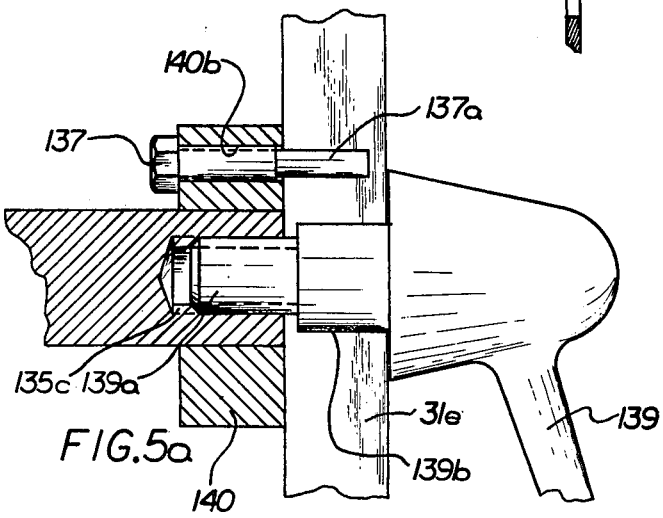
FIG. 5*a* is an enlarged view of a portion of FIG. 5 with additional parts sectioned therein.

Loader 20 gives good control of signature feed into generally vertically extending pocket P for several reasons. First, the quantity of signatures S in pack Q3 in pocket P is controlled by limit switch 145 mounted on one of the arms 131 and having a pivoted sensing arm 145*a* responsive to the thickness of signature pack Q3 in pocket P (after coupled together apparatus 20 and inserter 21 form unit 19 as shown in FIGS. 1*a* and 2) for controlling the driving of belts 71 and 73 of second feeding means 39 by deenergizing drive motor 69, so that a preselected thickness of signatures S in pack Q3 in pocket P is not exceeded. Switch 145 deenergizes motor 69 when a preselected pack thickness is reached, and reenergizes motor 69 after pack Q3 is partially depleted in pocket P. Second, one or more signature strippers 155 in FIGS. 2, 3 and 5: (1) are provided to hold signatures S in pocket P in FIG. 3, to prevent signatures S from climbing upwardly out of pocket P, and to prevent belts 71 from pulling signatures S upwardly out of pocket P; (2) are secured to nonrotatable shaft 135 against rotation thereon; and (3) are adjustable in arcuate position about the axis of shaft 35 by loosening tangential tightening screws 141 in split collars 140 in FIGS. 5 and 5*a* to permit limited rotation of shaft 135, which is normally secured against rotation by guide screw cylindrical portions 137*a* in slots 31*e*. Third, hold back assembly 147 in FIG. 2: (1) prevents the lower, righthand ends of signatures S from sliding out of pocket P into an L-shape under arm 131; (2) assures conveyor means 25 has a good bight on the lower right ends of signatures S to advance signatures S to the left in FIG. 2 toward face plate 24; and (3) comprises: (a) a plurality of upper arms 148, each spaced along and nonrotatably secured at its upper end to nonrotatable shaft 124 carried by the lower ends of arms 131; and (b) lower arm 149 pivotally connected at pivot 148*a* to upper arm 148 and having upper and lower rotatable rollers 150, 151 rotatably mounted on lower arm 149. Rollers 150 and 151 provide low frictional contact so a light signature S won't hang up since the rollers rotate, and assure that if one roller swings away from signatures S in pocket P, the other roller digs in as it swings about pivot 148*a*.

Loader 20 provides good controlled feed and entry of signatures S into generally vertically extending pocket P, removal of signatures S individually by inserter 21 and deposit of signatures S onto saddle 18*a* for many reasons by: (1) feeding signatures S into a horizontal position in hopper 35, where signatures S are in good stabilized condition and are under good control, before feeding into vertical pocket P, (2) controlling the optimum height of signatures S in horizontal hopper 35 by photocell 49*b*, (3) left end plate or backstop 68 of hopper 35 providing a uniform stopping action for signatures S entering hopper 35, and (4) properly locating suction manifold 105 in FIGS. 3 and 11–13 relative to hopper backstop 68 for providing proper feeding and reshingling of signatures S into metering gate 112 in FIG. 7, the bight of belts 71 and 73 in FIG. 13, and pocket P.

The invention may be embodied in other specific forms without departing from the spirit or essential characteristics thereof. The present embodiments are therefore to be considered in all respects as illustrative and not restrictive with the scope of the invention being indicated by the appended claims rather than by the foregoing description, and all changes which come within the meaning and range of equivalency of the claims are therefore intended to be embraced therein.

I claim:

1. Apparatus for feeding signatures into a generally vertically extending pocket in which the signatures are supported on a folded edge and from which the signatures are fed by a feed mechanism, said apparatus comprising a frame, a generally horizontally oriented hopper arranged to receive signatures in a generally horizontal array, first feeding means for feeding said signatures from a loading position in a shingled stream with the folded edge trailing into said hopper, and second feeding means for feeding a shingled stream of said signatures from said hopper, said second feeding means including means for feeding the signatures sequentially from the bottom of said hopper with the folded edge of each signature leading and for directing the signatures on folded edge into the generally vertically extending pocket, said second feeding means including bottom feeding means for sequentially feeding the signatures individually off the bottom of the pack of signatures in the hopper in a reshingled stream into said generally vertically extending feed pocket, said bottom feeding means including conveyor means forming the bottom of said hopper, and a vacuum manifold, said conveyor means including a perforated conveyor belt operatively traveling over the inlet side of said vacuum manifold for feeding said signatures into said reshingled stream relationship while signatures are fed off the bottom of the pack in the hopper, a signature stop adjustably mounted on the frame and movable relative to said pack of signatures for permitting said pack of signatures to have different lengths of signatures therein, and means for simultaneously moving said vacuum manifold and signature stop for maintaining the same length overlap step in the shingled stream of signatures for different length signatures.

2. Apparatus for feeding signatures into a generally vertically extending pocket in which the signatures are supported on a folded edge and from which the signatures are fed by a feed mechanism, said apparatus comprising a frame, feeding means for sequentially feeding said signatures, individually from a pack of signatures, in a shingled stream overlap with the folded edge of each signature leading, and directed into, the generally vertically extending pocket, said feeding means including conveyor means, and a vacuum manifold, said conveyor means including a perforated conveyor belt operatively traveling over the inlet side of said vacuum manifold and supporting said pack of signatures for moving said signatures into a shingled stream relationship while the signatures are fed from the pack, and means for adjustably mounting said vacuum manifold on said frame for adjustment in the direction of movement of said shingled stream to allow for variation in signatures in said direction of movement, a signature stop adjustably mounted on the frame and movable relative to said pack of signatures for permitting said pack of signatures to have different lengths of signatures therein, and means for simultaneously moving said vacuum manifold and signature stop for maintaining the same length overlap step in the shingled stream of signatures for different length signatures.

3. Apparatus as claimed in claim 2, further comprising roller means for supporting said perforated conveyor belt, and means for simultaneously moving said roller means with said vacuum manifold and said signature stop.

4. Apparatus, as claimed in claim 2, further comprising a support surface on said frame bowed in a direction transverse to the direction of travel of said shingled stream and located on the feed off side of said pack for bowing and giving longitudinal stiffness to at least the signature being fed from said pack.

5. Apparatus, as claimed in claim 2, further comprising side guides straddling said pack of signatures, adjustment means operatively connecting said side guides to said frame for adjustment inwardly to support at least part of the weight of said pack to take some of its weight off said perforated conveyor belt and vacuum manifold during feeding of said shingled stream.

6. Apparatus, as claimed in claim 2, further comprising said frame supporting said signatures at a loading position, said feeding means including spaced downstream from said loading position and said vacuum manifold a metering gate operatively associated with said conveyor belt.

7. Apparatus for feeding signatures into a generally vertically extending pocket in which the signatures are supported on a folded edge and from which the signatures are fed by a feed mechanism and with said pocket having an inlet side wall and other walls, said apparatus comprising a wheeled frame, feeding means on said frame for feeding said signatures from a loading position in a shingled stream with the folded edge of each signature leading and for directing the signatures on edge into the generally vertically extending pocket, a coupling means for operatively detachably coupling said wheeled frame and some walls of said vertically extending pocket, said feeding means including conveyor means for feeding said signatures in said shingled stream and for providing the inlet side wall of said vertically extending pocket formed with said some walls after coupling of said coupling means, and sensing means responsive to the thickness of the signature pack in the generally vertically extending pocket after coupling of said coupling means for controlling the driving of said conveyor means so that a preselected thickness of the signatures in the pack in the generally vertically extending pocket is not exceeded, said coupling means including a slot element extending parallel to the supporting surface on which said wheeled frame rolls, a horizontally extending pin element for entering said slot element, and clamping means for detachably locking said elements together, one of said elements being carried by said some walls of said vertical pocket and the other of said elements being carried by said wheeled frame.

8. Apparatus, as claimed in claim 7, wherein said feeding means includes a vacuum manifold, said conveyor means including a perforated belt operatively traveling over the inlet side of said vacuum manifold for moving said signatures into said shingled stream relationship while the signatures are fed from the pack at the loading position.

9. Apparatus as claimed in claim 7, wherein said feeding means includes:

a generally horizontally oriented hopper arranged to receive signatures in a generally horizontal array, first feeding means for feeding said signatures from a loading position in a shingled stream with the folded edges trailing into said hopper, and second feeding means for feeding a shingled stream of said signatures from said hopper, said second feeding means including means for feeding the signatures sequentially from the bottom of said hopper with the folded edge of each signature leading and for directing the signatures on folded edge into the generally vertically extending pocket.

* * * * *